US005904420A

United States Patent [19]

Dedoes

[11] Patent Number: 5,904,420

[45] Date of Patent: May 18, 1999

[54] FRAME FOR AUTOMATIC PAINT STIRRING EQUIPMENT

[75] Inventor: John T. Dedoes, Brighton, Mich.

[73] Assignee: Dedoes Industries, Inc., Walled Lake, Mich.

[21] Appl. No.: 09/153,517

[22] Filed: Sep. 15, 1998

[51] Int. Cl.[6] ..... B01F 7/20

[52] U.S. Cl. ..... 366/198; 366/605; 108/151; 108/192; 403/349

[58] Field of Search ..... 366/197, 198, 366/242–251, 605; 211/74, 186, 188, 189; 403/348, 349; 108/20, 151, 190, 192

[56] References Cited

U.S. PATENT DOCUMENTS

| | | | |
|---|---|---|---|
| 2,521,384 | 9/1950 | Marienthal | 366/249 |
| 2,757,910 | 8/1956 | O'Neill | 366/605 |
| 2,802,649 | 8/1957 | Stockton | 366/197 |
| 2,965,363 | 12/1960 | Worden | 366/197 |
| 3,118,653 | 1/1964 | Dedoes | 366/251 |
| 3,851,601 | 12/1974 | Davis | 403/349 |
| 3,869,218 | 3/1975 | Stoeber et al. | 108/190 |
| 4,225,248 | 9/1980 | Para | 366/251 |
| 4,299,500 | 11/1981 | Bassetti | 366/198 |
| 5,096,071 | 3/1992 | Neri | 366/605 |
| 5,160,198 | 11/1992 | Fillon | 366/605 |
| 5,169,232 | 12/1992 | Fillon et al. | 366/605 |
| 5,542,761 | 8/1996 | Dedoes | 366/605 |
| 5,800,057 | 9/1998 | Lesimple | 366/249 |

FOREIGN PATENT DOCUMENTS

| | | | |
|---|---|---|---|
| 127589 | 12/1984 | European Pat. Off. | 366/605 |
| 2102417 | 4/1972 | France | 366/198 |
| 2521493 | 8/1983 | France | 366/605 |
| 858607 | 12/1952 | Germany | 366/197 |
| 2203059 | 10/1988 | United Kingdom | 366/605 |

*Primary Examiner*—Charles E. Cooley
*Attorney, Agent, or Firm*—Gifford, Krass, Groh, Sprinkle, Anderson & Citowski, P.C.

[57] ABSTRACT

An improved frame is disclosed for automatic paint stirring equipment of the type which stirs cans of paint in a side-by-side relationship. Each can includes a cover having a stirring element rotatably mounted to the cover and a driven member secured to the stirring element. The improved frame includes a plurality of substantially identical drive assemblies wherein each drive assembly includes a drive mechanism for engaging and rotatably driving the drive members on the paint can covers. Each drive assembly furthermore includes an elongated planar top having two ends and which forms a shelf for supporting the paint cans. At least one, and preferably two, connectors are secured to each end of each drive assembly. Each connector has an upper and lower cylindrical portion which extend respectively above and below its associated drive assembly. A plurality of elongated tubular cylindrical supports then secure the drive assemblies together in a spaced apart and parallel relationship. The lower end of each support slidably receives the upper cylindrical of one connector while, similarly, the upper end of each support slidably receives the lower cylindrical portion of the connector on the next higher drive assembly. A pin and channel arrangement between the supports and the connectors releasably locks the supports and connectors together.

5 Claims, 2 Drawing Sheets

FRAME FOR AUTOMATIC PAINT STIRRING EQUIPMENT

BACKGROUND OF THE INVENTION

I. Field of the Invention

The present invention relates to automatic paint stirring equipment and, more particularly, to an improved frame for automatic paint stirring equipment.

II. Description of the Prior Art

Automatic paint stirring equipment of the type commonly found in automotive paint shops typically comprise a housing having a plurality of elongated planar shelves for supporting paint cans in a side-by-side relationship. These shelves are typically constructed of sheet metal while, similarly, the side panels for the housing are likewise constructed of sheet metal.

These previously known housings for automatic paint stirring equipment while adequate in operation, are difficult and time consuming to assemble. Typically, the manufacturer of the automatic paint stirring equipment ships the housing in a disassembled condition. Upon arrival at the automotive paint shop, the housing must be assembled.

The assembly of these previously known housings require the side walls, top, bottom and shelves to be screwed together by personnel at the automotive paint shop. Such assembly of the housing is not only difficult and time consuming to accomplish, but also frequently requires two laborers in order to complete the assembly of the housing. One laborer is required to position the shelf or sides of the housing while the other laborer actually makes the attachment between the sides and the shelf.

SUMMARY OF THE PRESENT INVENTION

The present invention provides an improved frame for automatic paint stirring equipment which overcomes all of the above-mentioned disadvantages of the previously known devices.

In brief, the improved frame of the present invention comprises a plurality of drive assemblies. Each drive assembly includes means for rotatably driving the driven members on the paint can covers in order to rotatably drive the stirring element in the interior of the paint can. Furthermore, each drive member includes an elongated planar top having two ends.

In order to secure the drive assemblies together in a spaced apart and parallel relationship at least one, and preferably two, connectors are secured to each end of each drive assembly. Each connector includes an upper and lower cylindrical portion such that the upper cylindrical portion extends upwardly from its associated drive assembly while, likewise, the lower cylindrical portion extends downwardly from its associated drive assembly.

A plurality of elongated tubular cylindrical supports open at each end are provided for securing the drive assemblies together in order to form vertically spaced shelves. Each support is open at each end so that a lower end of the support slidably engages the upwardly extending cylindrical portion of the connector on one drive assembly. Similarly, the downwardly extending cylindrical portion on the connector on the next higher drive assembly is slidably received within the upper end of the tubular support. In doing so, the tubular supports secure the drive assemblies together in a spaced apart relationship thus forming vertically spaced shelves, each dimensioned to receive a plurality of paint cans in a side-by-side relationship.

In the preferred embodiment of the invention, an L-shaped channel is formed on each cylindrical portion of each connector. A radially inwardly extending pin at each end of each support is then slidably received within the channel of its associated connector cylindrical portion. Thus, to lock the supports to the connectors, the pin in the support is aligned with the channel and inserted over the cylindrical portion until the pin registers with the second leg of the L-shaped channel. Upon such registration, the tubular support is twisted thus moving the pin into the horizontally extending portion of the L-shaped channel thus locking the support and connector together.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
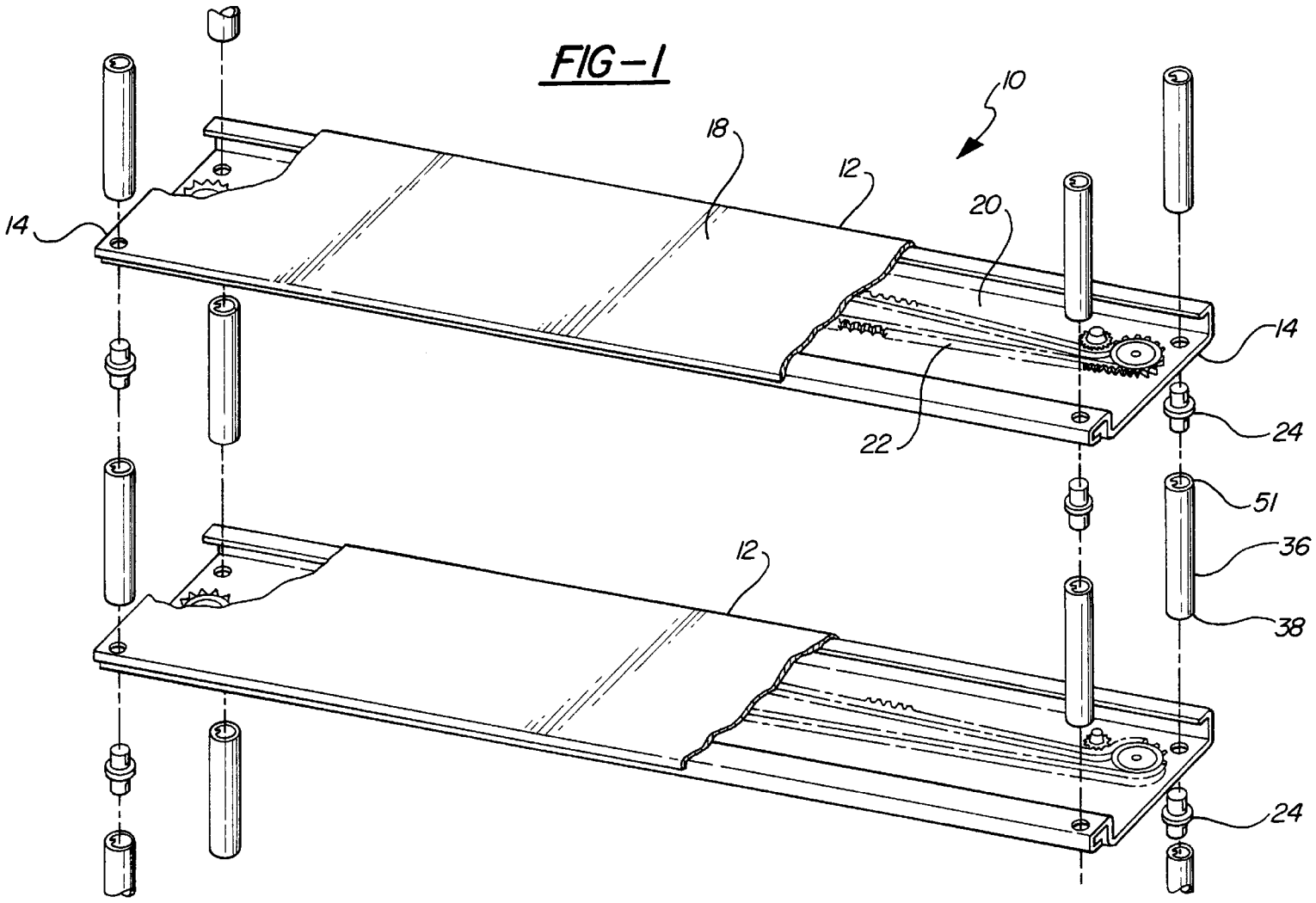
FIG. 1 is an exploded elevational view illustrating a portion of a preferred embodiment of the present invention.

With reference first to FIG. 1, a preferred embodiment of the improved frame 10 of the present invention for automatic paint stirring equipment is thereshown and comprises a plurality of drive assemblies 12, each of which are substantially identical to each other.

Each drive assembly 12 is elongated and generally rectangular in shape thus having two ends 14. An upper planar cover 18 extends across the top of the drive assembly 12 thus forming an interior channel 20 in the drive assembly 12. A drive mechanism 22 for driving a driven member 124 (FIG. 2) on a paint can cover 126 is contained within the interior 20 of the drive assembly 12. In the well-known fashion, the driven member 124 on the paint can cover 126 is drivingly connected to a stirring element 128 within the interior of a paint can 130 by a paddle shaft 132.

Figure 3:
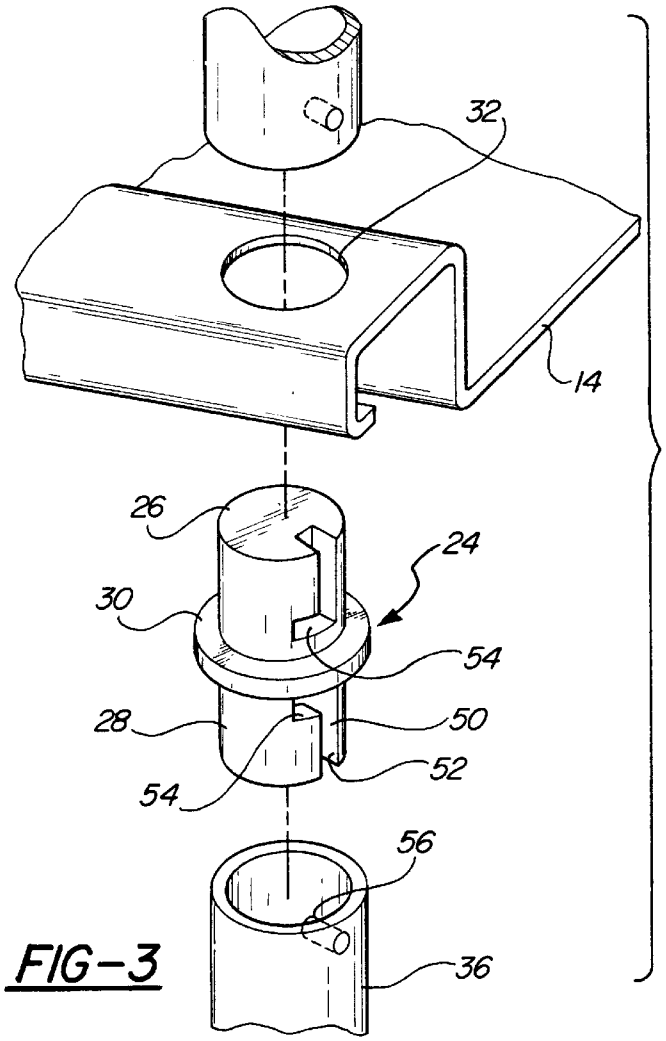
FIG. 3 is a fragmentary exploded view illustrating a portion of the preferred embodiment of the present invention.
Figure 2:
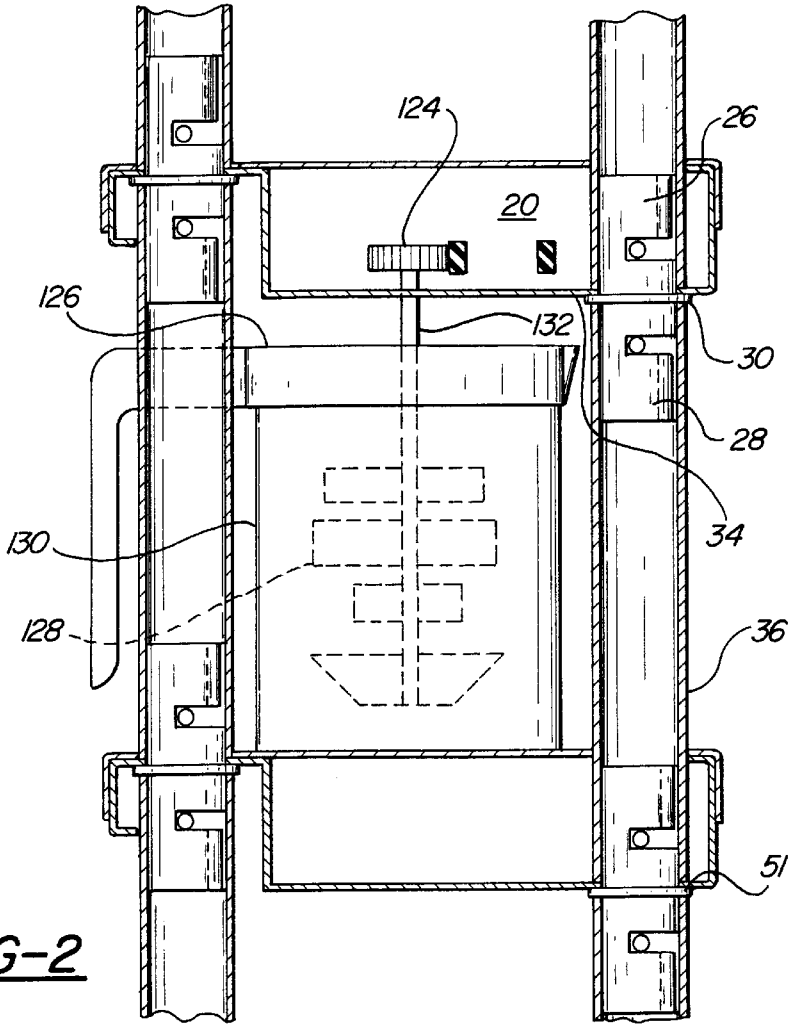
FIG. 2 is a fragmentary side sectional view illustrating the preferred embodiment of the present invention.

With reference now particularly to FIGS. 2 and 3 at least one, and preferably two, connectors 24 are associated with each end 14 of each drive assembly 12. Each connector 24 includes an upper cylindrical portion 26 as well as a lower cylindrical portion 28. A radially outwardly extending flange 30 is disposed between the upper and lower cylindrical portions 26 and 28.

Still referring to FIGS. 2 and 3, an opening 32 is formed through the drive assembly 12 for each connector 24. The diameter of the opening 32 is greater than the diameter of the upper cylindrical portion 26 but less than the diameter of the outwardly extending radial flange 30. Thus, with the upper cylindrical portion 26 positioned through the opening 32 as illustrated in FIG. 2, the flange 30 abuts against and supports the bottom 34 of the drive assembly 12.

With reference now to FIGS. 1 and 2, in order to secure adjacent drive assemblies 12 together to form vertically spaced shelves, a plurality of elongated tubular and cylindrical supports 36 extend between vertically adjacent drive assemblies 12. A lower end 38 of each support 36 is slidably received over the upwardly extending cylindrical portion 26 on one connector 24. Similarly, the upper end 51 of each tubular support is slidably received over the downwardly extending cylindrical portion 28 of the connector 24 on the next higher shelf assembly 12.

Preferably, two spaced connectors 24, and thus two spaced supports 36 are provided at each end 14 of each drive assembly 12. Furthermore, the cylindrical portions 26 and 28 of each connector 24 are preferably equal in diameter to each other.

With reference now especially to FIG. 3, in order to firmly lock the supports 36 to their associated connectors 24, an L-shaped channel 50 having an axially extending leg 52 and a circumferentially extending leg 54 is provided through each cylindrical portion 26 and 28 of each connector 24. A radially inwardly extending pin 56 is then provided at each end of each support 36. The pin 56, furthermore, is dimensioned to slidably receive within the channel 50.

Consequently, in order to lock the supports 36 to their associated connectors 24, the pin 56 is aligned with the L-shaped channel 50 and then slid over the cylindrical portion 26 or 28 until the pin is at the junction of the axial leg 52 and circumferential leg 54 of the channel 50. The support 36 is then rotated thus moving the pin 56 into the circumferential portion 54 of the channel 50 thereby locking the support 36 to the connector 24.

The assembly of the frame 10 of the present invention is not only simple and fast, but can also be accomplished by a single person. More specifically, with the connectors 24 positioned in the openings 32 of one drive assembly 12, all four tubular supports 36 are secured to the connectors by inserting the supports 36 over the connector cylindrical portions 26 and then twisting the supports 36 in the previously described fashion.

Four connectors 24 are then secured to the upper ends of the four supports 36 which are secured to the drive assembly 12. After the connectors 24 are secured to the upper ends of the supports 36, the next higher drive assembly 12 is positioned on top of the connectors 24 such that the upper cylindrical portions 26 of the connectors 24 slidably extend through the openings 32 in the next higher drive assembly 12. The above-identified process is then repeated until the desired number of shelves formed by the drive assemblies 12 is obtained.

From the foregoing, it can be seen that the present invention provides an improved frame for automatic paint stirring equipment which is not only simple and fast to assemble, but also inexpensive in construction. Having described my invention, many modifications thereto will become apparent to those skilled in the art to which it pertains without deviation from the spirit of the invention as defined by the scope of the appended claims.

I claim:

1. Automatic paint stirring equipment for stirring cans of paint in a side-by-side relationship, each paint can having a cover with a stirring element rotatably mounted to the cover and a driven member secured to the stirring element and positioned above the can, an improved frame comprising:

a plurality of drive assemblies, each having means for rotatably driving said driven members, each drive assembly having an elongated planar top with two ends, means for connecting said drive assemblies together so that said tops of said drive assemblies are vertically spaced apart from each other and form shelves for supporting the paint cans in a side by side relationship, wherein said connecting means further comprises at least one connector secured to each end of each drive assembly, each connector having an upper and a lower axially adjacent cylindrical portion, each connector being connected to said drive assembly such that said lower cylindrical portion extends from a lower side of its associated drive assembly and said upper cylindrical portion extends from an upper side of its associated drive assembly, a plurality of elongated tubular cylindrical supports open at each end, one end of said support being dimensioned to slidably receive said upper cylindrical portion of said connector on one drive assembly and the other end of said support being dimensioned to slidably receive said lower cylindrical portion of said connector on the next upper drive assembly from said one drive assembly.

2. The invention as defined in claim 1 and comprising means for locking said connectors to their associated supports.

3. The invention as defined in claim 2 wherein said locking means comprises an L-shaped channel formed in each cylindrical portion of each connector, and a radially inwardly extending pin secured to each end of each support, said pin dimensioned to slidably fit in said channel.

4. The invention as defined in claim 1 wherein said connector cylindrical portions are diametrically equal to each other.

5. The invention as defined in claim 1 wherein each connector further comprises a radially outwardly extending flange between said cylindrical portions, and wherein said upper cylindrical portion extends through an opening in said drive assembly, said opening having a diameter greater than said upper cylindrical portion and less than the diameter of the flange.

* * * * *

UNITED STATES PATENT AND TRADEMARK OFFICE

CERTIFICATE OF CORRECTION

PATENT NO. : 5,904,420

DATED : May 18, 1999

INVENTOR(S) : John T. Dedoes

It is certified that error appears in the above-identified patent and that said Letters Patent is hereby corrected as shown below:

On the title page, Item [57], line 16, change "secure" to --secures--.

On the title page, Item [57], line 19, after "cylindrical" insert --portion--.

Column 1, line 12, change "comprise" to --comprises--.

Column 1, line 61, change "on" to --of--.

Column 2, line 65, change "extend" to --extends--.

Column 3, line 1, change "on one" to --of its associated--.

Signed and Sealed this

Seventh Day of December, 1999

*Attest:*

Q. TODD DICKINSON

*Attesting Officer*

*Acting Commissioner of Patents and Trademarks*